United States Patent [19]

Meyer

[11] 4,363,198

[45] Dec. 14, 1982

[54] ANCHOR SYSTEM

[76] Inventor: Gordon R. Meyer, Rte. 1, Box 7, Cotulla, Tex. 78014

[21] Appl. No.: 189,064

[22] Filed: Sep. 22, 1980

[51] Int. Cl.[3] ..... B66D 1/04

[52] U.S. Cl. ..... 52/155

[58] Field of Search ..... 52/155, 156; 254/375

[56] References Cited

U.S. PATENT DOCUMENTS

| | | | |
|---|---|---|---|
| 610,184 | 9/1898 | Hill | 52/155 |
| 1,241,472 | 9/1917 | Adamson | 52/155 |
| 1,308,939 | 7/1919 | Eggleston | 52/155 |
| 3,500,598 | 3/1970 | Ettinger | 52/155 |
| 4,003,169 | 1/1977 | Young | 52/155 |

FOREIGN PATENT DOCUMENTS

| | | | |
|---|---|---|---|
| 572980 | 2/1958 | Italy | 52/155 |

*Primary Examiner*—J. Karl Bell

*Attorney, Agent, or Firm*—Cox & Smith Incorporated

[57] ABSTRACT

An anchoring system for a motor vehicle including two anchor means and a slide hammer means for driving the anchor means into the ground and for positioning on one of the anchor means for connecting to the anchor means with a cable secured to the slide hammer means and the one of the anchor means to provide an anchoring system which may be connected with a wench cable for pulling a stuck vehicle out.

7 Claims, 3 Drawing Figures

ANCHOR SYSTEM

BACKGROUND OF THE INVENTION

This invention relates generally to an anchor system and in particular to an anchor apparatus and method for use with a wench on a motor vehicle.

Anchor systems have been known in the prior art and examples of known anchor systems are shown in U.S. Pat. Nos. 1,088,344; 1,248,470; 3,500,598; and, 4,003,169. A typical prior art anchor system utilizes two spaced stakes which are interconnected so that a table from a wench may be connected to one of the stakes. The stakes form a anchor means and act in combination with each other to allow a vehicle to be moved from a stuck position by a wench mounted thereon.

The desirability of having stakes which may be positioned at any location is apparent since a stationary object is not always available for securing with a cable on a wench to pull out a stuck vehicle. It is also desirable that the anchor system can be carried with the vehicle and easily transportable so that it will be available when needed. It is also desirable that the anchor system be easily usable by anyone whereby it may be inserted in the ground and removed as needed.

It is an object of the present invention to overcome some of the problems associated with the prior art by providing an anchor system that may be easily and simply stored on a vehicle so that it will be available for use when needed. The anchor system of the invention is inexpensive to manufacture and can be manufactured of commonly available materials. It is also simple to use and may be easily positioned for connecting with a cable on a wench and thereafter be easily removed from the ground for storage on the vehicle. Other objects of the invention will be apparent from the following detailed description of the invention.

SUMMARY OF THE INVENTION

A portable anchor system for a motor vehicle wench, including first and second anchor members for insertion in the ground, and a slide hammer means for driving the anchor members into the ground and for interconnecting the anchor members. After interconnecting a cable from a wench may be connected to one of the anchor members so that a vehicle may be pulled out. The anchor members remain in position since they are interconnected.

BRIEF DESCRIPTION OF THE DRAWING

FIG. 1 is a side view partly in cross-section showing the anchor system positioned in the ground and connected with a cable from a wench of the like.

BRIEF DESCRIPTION OF THE PREFERRED EMBODIMENT

Figure 1:
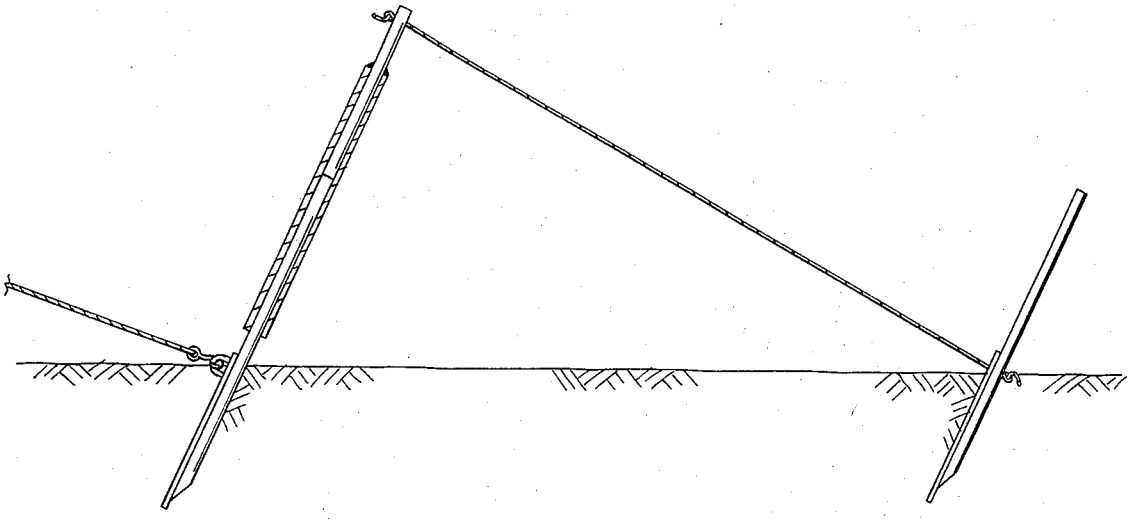

Referring to FIG. 1 of the drawing, there is shown an embodiment of the anchor apparatus of the invention. The anchor apparatus A is shown to a wench cable (WC) and in position in the ground (G) for pulling out a stuck vehicle.

Figure 2:
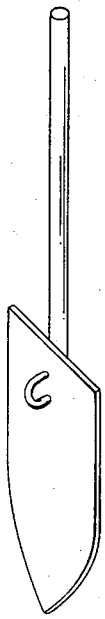
FIG. 2 is a view of one of the anchor members.

Referring to FIGS. 1 and 2, there is shown an anchor means 10 which includes a spade portion 11 having a V-shaped lower end 12. An upstanding cylindrical shaft portion 13 is rigidly connected to the spade portion by suitable means such as by welding. Attached to the face 14 of the spade portion is a loop 15 which is rigidly secured to the face of a spade portion by suitable means such as by welding. As more fully shown in FIG. 1, the loop 15 is adapted to be connected with another hook or similar member. As will be apparent, the invention includes two similar anchor means.

Figure 3:
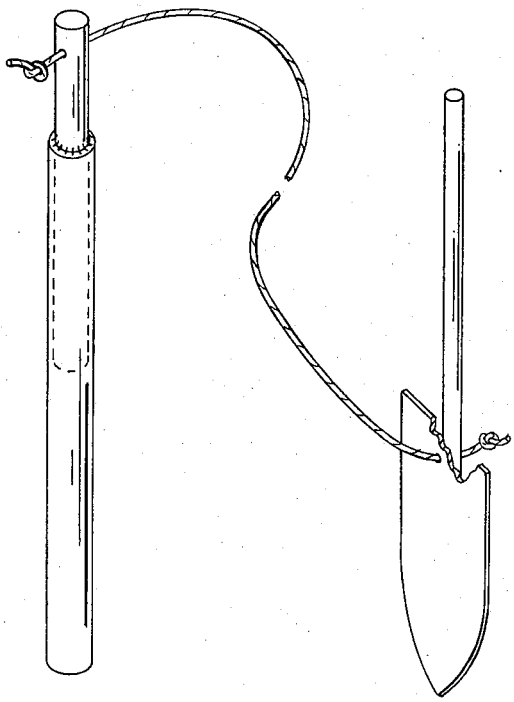
FIG. 3 is a view of the slide hammer and connecting means for the anchor members and the other of the anchor member.

Referring to FIG. 3 of the drawing, there is shown a slide hammer means 16 which is used to connect the anchor means during use and to drive the anchor means into the ground (G) for use. The slide hammer means 16 includes a hollow cylindrical member 17 having a cylindrical inner surface 18 for slidably receiving the shaft portion 13. A solid bar 19 is inserted into the cylindrical member 17 and rigidly secured therein by suitable means such as welding. The solid bar 19 includes a lower cylindrical surface 20 which engages the upper surface 13' of the shaft portion 13 for driving the anchor means into position as shown in FIG. 1. Attached to the upper end of bar 19 is a cable 21 which extends through an aperture 22 in the bar 19. A knot is formed in the cable 21 to retain it in the aperture 22.

The cable 21 also extends through an aperture 24 in anchor means 10'. The anchor means 10' and the anchor means 10 are identical except for the loop 15 and aperature 24. A knot 25 is formed in the cable 21 to retain it in the aperture 24. Like reference numerals are used on like structure of the anchor means 10 and 10'. The substantial identical structure of the anchor means 10 and 10' provide economy of manufacture and allow common use of the hammer means 16.

The use of the anchor system of the invention is as follows. The anchor system of the invention is of such a size and dimensions so as to allow it to be carried on a vehicle in a suitable storage means such as a flexible bag or rigid container. When it is desired to utilize the anchor apparatus it is removed from its container. The anchor means 10 and 10' are then driven into the ground in spaced locations with the slide hammer means 16 as shown in FIG. 1. As will be apparent, the slide hammer means 16 will slide onto the shafts 13 and may be hammered against the upper ends 13' of the shafts 13 so as to drive the anchor means 10 and 10' into the ground. The spade portion 11 has a relatively large surface area compared to the shaft 13 so that it will provide pulling resistance through the wench cable (WC). After both of the anchor means 10 and 10' are positioned into the ground at spaced locations the hammer means 16 is positioned on the anchor means 10 as shown in FIG. 1. It is understood that anchor means 10 and 10' are spaced apart no further than the cable 21 will reach. This is accomplished by driving the anchor means 10' into the ground first. The slide hammer 16 is then positioned on the anchor means 10 and the cable 21 is pulled tight. At this point the anchor means 10 is driven into the ground by sliding the hammer means on the shaft portion 13 to strike the upper surface 13' against the surface 20. A hook on the wench cable WC is then connected in the other loop 15. As will be apparent the force on the forward most anchor means 10 which is connected to the wench cable WC is transferred through the cable 21 to the anchor means 10'. By connecting the wench cable WC to the lower most portion of the forward most anchor means 10 and by connecting the cable 21 to the upper most portion of the forward anchor means 10 (through the hammer means) and the lower portion of the rearward anchor means 10, the maximum pulling resistance is provided to the cable WC.

While there has been shown and described a preferred embodiment of an anchor system in accordance with the invention, it will be appreciated that many changes and modifications may be made therein without, however, departing from the essential spirit of the invention within the scope of the claims.

I claim:

1. A portable anchor apparatus for a motor vehicle wench which may be carried and stored on the vehicle, comprising:

first and second anchor members for insertion in the ground in spaced relationship;

said first and second anchor members each having a lower spade portion for insertion in the ground and an upwardly extending, elongated post portion for receiving a slide hammer;

a slide hammer means having an elongated portion for slidably receiving the elongated post portion of the anchor members to operatively engage the post portion of each anchor member for driving the same into the ground upon applying a sliding hammering force thereto and for retaining the slide hammer means on the elongated post portion when the slide hammer means is retainably positioned on an anchor member; and a cable means secured to the slide hammer means and to the second of the anchor means to interconnect the anchor means when the slide hammer means is positioned in its retaining position on the post portion of the first anchor means.

2. The apparatus as set forth in claim 1, wherein:

the first anchor means has a connecting means secured to the upper portion of the spade portion for securing to the wench.

3. The apparatus as set forth in claim 1, wherein:

the cable means is a flexible cable.

4. The apparatus as set forth in claim 1, wherein:

the cable means is secured to the upper portion of the slide hammer means.

5. The apparatus as set forth in claim 1, wherein:

the cable means is secured to the upper portion of the spade portion of the second anchor means.

6. A method for pulling out a stuck vehicle with a wench, comprising the steps of:

driving a first anchor means into the ground with a slide hammer means;

driving a second anchor means into the ground with the slide hammer means in spaced relation to the first anchor member and at a different distance from the vehicle;

slidably positioning the slide hammer means in driving position on the anchor means located closest to the stuck vehicle to retain the slide hammer means in a retaining position with a cable means secured to the upper portion of the slide hammer means and to the lower portion of the anchor second means located farthest from the stuck vehicle to interconnect the anchor means; and connecting a wench to the lower portion of the anchor means located closest to the stuck vehicle.

7. The method as set forth in claim 6, including:

driving the second anchor means into the ground before driving the first anchor means into the ground;

positioning the slide hammer means on the first anchor means and extending the cable means to an extended position until it is taunt; and driving the first anchor means into the ground at the extended position where the cable means is taunt.

* * * * *